US005641121A

United States Patent [19]

Beck et al.

[11] Patent Number: 5,641,121

[45] Date of Patent: Jun. 24, 1997

[54] CONVERSION OF NON-ACCUMULATOR-TYPE HYDRAULIC ELECTRONIC UNIT INJECTOR TO ACCUMULATOR-TYPE HYDRAULIC ELECTRONIC UNIT INJECTOR

[75] Inventors: Niels J. Beck, Bonita; Robert L. Barkhimer, Poway, both of Calif.

[73] Assignee: Servojet Products International

[21] Appl. No.: 492,969

[22] Filed: Jun. 21, 1995

[51] Int. Cl.[6] ..... F02M 47/02

[52] U.S. Cl. ..... 239/92; 239/1; 239/600

[58] Field of Search ..... 239/92, 96, 533.8, 239/1, 600

[56] References Cited

U.S. PATENT DOCUMENTS

| | | | |
|---|---|---|---|
| Re. 33,270 | 7/1990 | Beck et al. . | |
| 2,985,378 | 5/1961 | Falberg . | |
| 3,610,529 | 10/1971 | Huber | 239/96 |
| 4,605,166 | 8/1986 | Kelly . | |
| 4,628,881 | 12/1986 | Beck et al. | 123/447 |
| 4,674,688 | 6/1987 | Kanesaka . | |
| 4,948,049 | 8/1990 | Brisbon | 239/96 X |
| 4,962,887 | 10/1990 | Matsuoka | 239/533.8 X |
| 5,191,867 | 3/1993 | Glassey . | |
| 5,241,935 | 9/1993 | Beck et al. . | |
| 5,287,838 | 2/1994 | Wells . | |
| 5,325,834 | 7/1994 | Ballheimer et al. . | |
| 5,553,781 | 9/1996 | Barkhimer et al. | 239/88 |

FOREIGN PATENT DOCUMENTS

| | | | |
|---|---|---|---|
| 67761 | 4/1985 | Japan | 239/92 |

*Primary Examiner*—Kevin Weldon
*Attorney, Agent, or Firm*—Nilles & Nilles, S.C.

[57] ABSTRACT

A non-accumulator-type hydraulic electronic unit injector assembly can be converted to an accumulator-type hydraulic electronic unit injector assembly simply by subjecting the nozzle needle of the injector to downwardly closing forces arising from fluid pressure in the high pressure chamber of the intensifier. This modification causes the needle to remain seated upon intensification of fluid pressure in the high pressure chamber and permits fuel injection to commence only upon subsequent pressure decay in the high pressure chamber. An accumulator volume is formed beneath the blowback avoidance check-valve of the converted injector and can, if necessary, be enlarged by adding the spring chamber of the assembly to the accumulator volume. The resulting assembly could conceivably be retrofitted into an existing injection system on site, or could be assembled as new construction using primarily stock non-accumulator-type assembly components. Manufacturing expenses can thus be sharply reduced, thereby promoting retrofitting, low-volume production, and/or standardization.

11 Claims, 4 Drawing Sheets

CONVERSION OF NON-ACCUMULATOR-TYPE HYDRAULIC ELECTRONIC UNIT INJECTOR TO ACCUMULATOR-TYPE HYDRAULIC ELECTRONIC UNIT INJECTOR

BACKGROUND OF THE INVENTION

1. Field of the Invention

The invention relates to hydraulic electronic unit injector (HEUI) assemblies and, more particularly, to a method of convening a non-accumulator-type HEUI assembly to an accumulator-type HEUI assembly and to the injector assembly thus formed.

2. Discussion of the Related Art

Hydraulic electronic unit injector (HEUI) assemblies have gained increased acceptance in recent years because they permit more precise control of fuel injection timing and quantity than is possible with traditional jerk-type injector assemblies and thus can significantly reduce exhaust emissions and improve fuel economy. Both accumulator-type and non-accumulator-type HEUI assemblies are known and both employ pulse width metering and/or pressure metering to control the timing and quantity of fuel injection. As will now be detailed, however, the manner in which energy for injection is stored and released differs fundamentally between the two types of assemblies.

A non-accumulator-type HEUI assembly is commercially available from Caterpillar, Inc. of Peoria, Ill. and is characterized by a needle assembly, a pressure intensifier assembly, and a solenoid actuated popper valve. The solenoid valve is operable to selectively connect a low pressure chamber of the pressure intensifier assembly to a source of fluid pressure and to vent, thus pressurizing or depressurizing a high pressure chamber of the intensifier assembly. The high pressure chamber is fluidically coupled to a fuel supply rail and to a nozzle cavity of the needle assembly. The needle lifts to permit injection whenever fluid pressure in the high pressure chamber increases above a designated level (determined primarily by a needle return spring) and closes whenever the fluid pressure in the high pressure chamber decreases beneath this same level. This type of injector assembly exhibits marked drawbacks and disadvantages.

For instance, injection energy must be transferred very rapidly, i.e., simultaneously with injection. This rapid energy transfer requires an extremely fast acting valve and leads to relatively high parasitic losses. Indeed, for peak injection pressures of about 1200 bar, it is estimated that the injector assembly uses about 5% of engine power.

Secondly, a non-accumulator-type HEUI assembly cannot be used in an expanding cloud injection system (ECI system). An ECI system is one which injects nearly the entire mass of each fuel charge at a decreasing rate such that successive fuel droplets have high separating velocities. Injection in this manner prevents droplet agglomeration and inhibits burning of liquid fuel, thus reducing smoke and emissions. The construction and operation of such an ECI system and its advantages are discussed in detail in a commonly assigned patent application Ser. No. 08/227,868, filed Apr. 18, 1994 in the name of N. John Beck and entitled "Expanding Cloud Fuel Injection System, now U.S. Pat. No. 5,392,745."

In a non-accumulator-type injector assembly, on the other hand, fuel is necessarily ejected at a rate that increases through much of the injection event. Injection at an increasing rate causes successive fuel droplets to travel at higher velocities and leads to droplet agglomeration and undesired liquid fuel burning.

Thirdly, fluid pressure in the nozzle cavity decreases rapidly upon intensifier plunger reversal and accompanying pressure decay, resulting in very rapid and undamped needle closure which can lead to premature wear and failure of the needle and associated valve seat.

Many of the drawbacks of non-accumulator-type HEUI assemblies can be avoided or at least alleviated through the use of accumulator-type HEUI assemblies. An accumulator-type HEUI assembly differs from a non-accumulator-type HEUI assembly primarily in that it permits the energy for fuel injection to be applied prior to the injection event and to be stored at a location near the needle until injection actually takes place rather than being applied during the injection event as in a non-accumulator-type injector assembly. Such assemblies are typically characterized by the use of (1) an accumulator in one-way fluid communication with the intensifier high-pressure chamber and in two-way fluid communication with the nozzle cavity and (2) a control cavity which places the high pressure chamber of the intensifier in two-way fluid communication with the upper surface of the needle plunger. Intensification of fuel pressure in the high pressure chamber forces fuel into the accumulator but does not immediately lead to injection because lifting forces imposed on the needle by accumulator pressure are opposed by an equal pressure in the control cavity. Injection is initiated by de-energizing the solenoid valve to vent the intensifier low pressure chamber and to reverse plunger movement. The resulting pressure decay in the high pressure chamber and control cavity removes opposing forces on the needle and permits accumulator pressure in the nozzle cavity to lift the needle. Fuel injection terminates when lifting forces imposed by fluid pressure in the nozzle cavity drop below closing forces imposed by a needle return spring and by the then-diminished fluid pressure in the control cavity. Accumulator-type HEUI assemblies of this type are disclosed, for example, in U.S. Pat. No. Reissue 33,270 to Beck et al.

Accumulator-type HEUI assemblies can employ much slower acting valves than are required by non-accumulator-type HEUI assemblies because the injection energy can be applied at a relatively leisurely pace prior to injection. Indeed, intensification in an accumulator-type assembly can take place about one-tenth as fast as is required in a non-accumulator-type assembly with about half the parasitic losses. In addition, because injection takes place solely under the control of pressurized fluid trapped in an accumulator which is at a peak value when injection commences, nearly the entire mass of each fuel charge is injected at a steadily decreasing rate. An accumulator-type HEUI assembly thus is readily suitable for use in an expanding cloud injection process. Moreover, because fuel pressure in the nozzle cavity ceases to decay upon needle closure, the needle lifting forces imposed thereby never drop more than slightly below the needle closing force and thus serve to damp needle closure, thereby increasing needle life and reducing the chances of premature failure.

One problem with accumulator-type HEUI assemblies is that they are not at present widely available. Manufacturers of non-accumulator-type HEUI assemblies are reluctant to convert their operations to the production of accumulator-type HEUI assemblies, possibly because wholesale retooling and other expenses heretofore considered to be required for such conversion were considered cost prohibitive. These same concerns heretofore have stifled the conversion of preassembled non-accumulator HEUI assemblies to accumulator HEUI assemblies.

OBJECTS AND SUMMARY OF THE INVENTION

It is therefore an object of the invention to relatively quickly and easily convert a non-accumulator-type HEUI assembly into an accumulator-type HEUI assembly either by converting a preassembled unit or by assembling a new unit using primarily stock non-accumulator-type HEUI assembly components.

In accordance with a first aspect of the invention, the method includes subjecting a nozzle needle of the injector assembly to forces arising from fluid pressure in a high pressure chamber of a pressure intensifier of the assembly so as to cause the needle to remain seated upon intensification of fluid pressure in the high pressure chamber and to permit fuel injection to commence only upon subsequent pressure decay in the high pressure chamber. The subjecting step preferably comprises placing a needle plunger in two-way fluid communication with the high pressure chamber.

If the stock injector assembly lacks a blowback prevention check valve in the fluid discharge passage, it will be necessary to place a non-return element in the fuel discharge passage which permits substantially unrestricted fluid flow towards the nozzle cavity from the high pressure chamber but which at least substantially prevents return fluid flow therethrough, thereby forming an accumulator volume beneath the check valve. If this accumulator volume is insufficient, additional accumulator volume can be obtained by isolating the spring chamber from direct fluid communication with the common rail and by placing the spring chamber in direct fluid communication with the fuel discharge passage at a location fluidically downstream of the non-return element.

Another object of the invention is to provide an accumulator-type HEUI assembly which can be manufactured with only minor modifications to an existing non-accumulator-type HEUI assembly design.

In accordance with another aspect of the invention, this object is achieved by providing a fuel injector assembly comprising a body in which is disposed a nozzle needle, a needle plunger, an intensifier, and a spacer. Formed in the body are a fuel supply passage for the supply of a pressurized fluid from a fuel source, a fuel discharge passage having a non-return element formed therein, and a central axial bore presenting a lower nozzle cavity connected to an outlet of the fuel discharge passage. The nozzle needle is disposed in the axial bore and presents a lower needle tip around which is disposed the nozzle cavity. The needle plunger has a lower end which engages an upper end of the needle and has and upper end around which is disposed an upper control cavity, an intermediate portion of the needle plunger being surrounded by a spring cavity in which is disposed a needle return spring, and the spring chamber being sealed at a lower portion thereof and having an upper portion opening into the fuel discharge passage at a location beneath the non-return element. The intensifier is disposed in the body and has a relatively large diameter piston surface and a relatively small diameter plunger surface, a low pressure chamber being formed fluidically above the piston surface and being selectively connectable to a source of pressurized fluid and to vent, and a high pressure chamber being formed fluidically beneath the plunger surface and being connectable to the fuel supply passage. The spacer is disposed in the body beneath the intensifier and has (1) a bore formed therein which sealingly and slidably receives the upper end of the needle plunger, the upper cavity being formed by a portion of the spacer bore above the needle plunger, and (2) a passage formed therethrough connecting the upper cavity to the high pressure chamber and permitting two-way fluid flow therethrough.

Other objects, features, and advantages of the present invention will become apparent to those skilled in the art from the following detailed description and the accompanying drawings. It should be understood, however, that the derailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments are illustrated in the accompanying drawings in which like reference numerals represent like parts throughout, and in which.

DETAILED DESCRIPTION OF THE PREFERRED EMBODIMENTS

1. Resumé

Pursuant to the invention, a non-accumulator-type hydraulic electronic unit injector assembly can be converted to an accumulator-type hydraulic electronic unit injector assembly simply by modifying the assembly to subject the nozzle needle of the injector to forces arising from fluid pressure in the high pressure chamber of the intensifier. This modification causes the needle to remain seated upon intensification of fluid pressure in the high pressure chamber and permits fuel injection to commence only upon subsequent pressure decay in the high pressure chamber. An accumulator volume is formed beneath the blowback avoidance check-valve of the converted injector, and this accumulator volume can be enlarged by adding the spring chamber of the assembly to the accumulator volume. The resulting assembly can be retrofitted into an existing injection system on site or assembled as new construction using primarily stock non-accumulator-type assembly components. Manufacturing expenses can thus be sharply reduced, thereby promoting retrofitting, low-volume production, and/or standardization.

2. Construction and Operation of Non-Accumulator-Type HEUI Assembly

Figure 1:
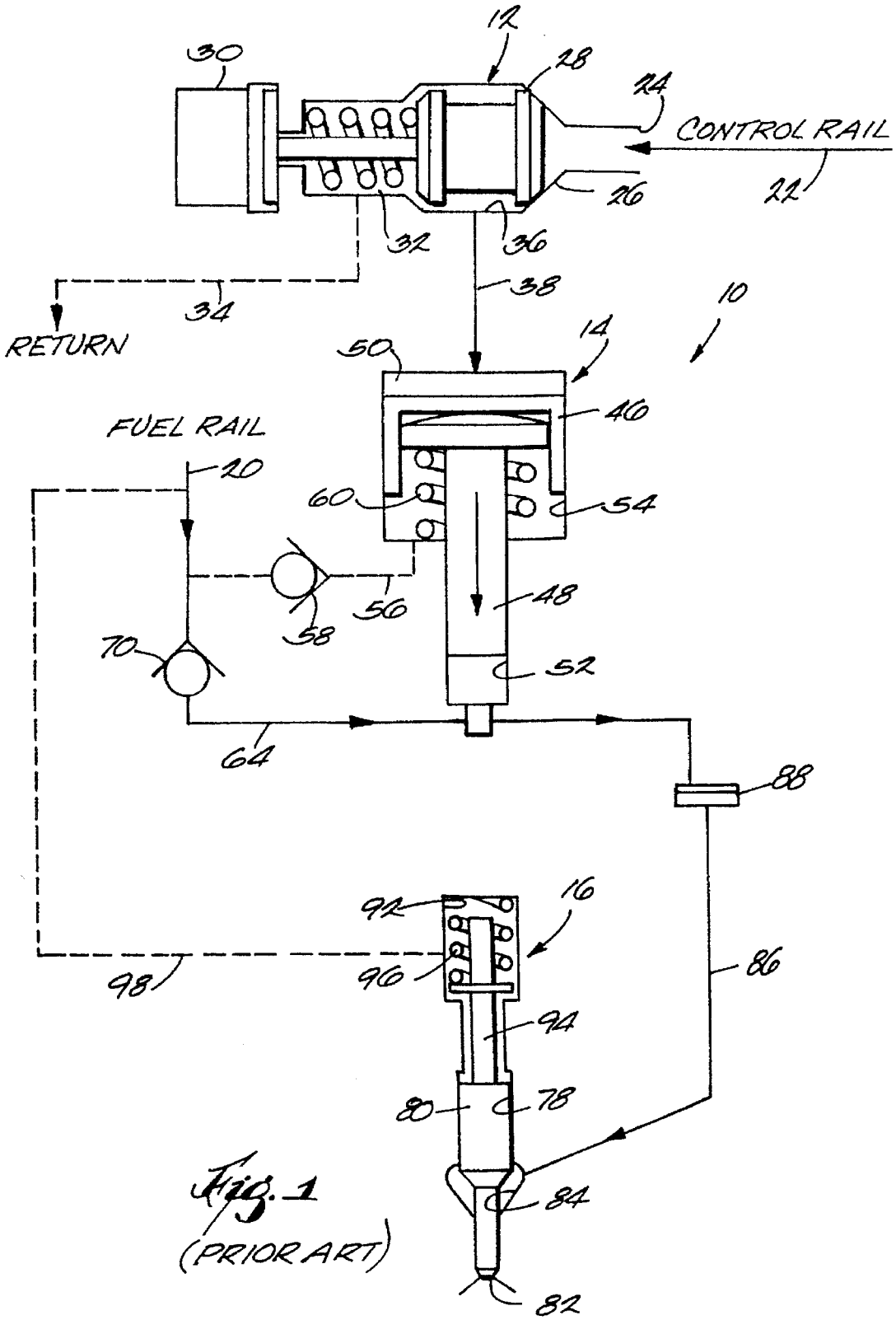
Fig. 1 (PRIOR ART)
FIG. 1 schematically represents a prior art non-accumulator-type HEUI assembly, appropriate labelled "PRIOR ART"
Figure 2:
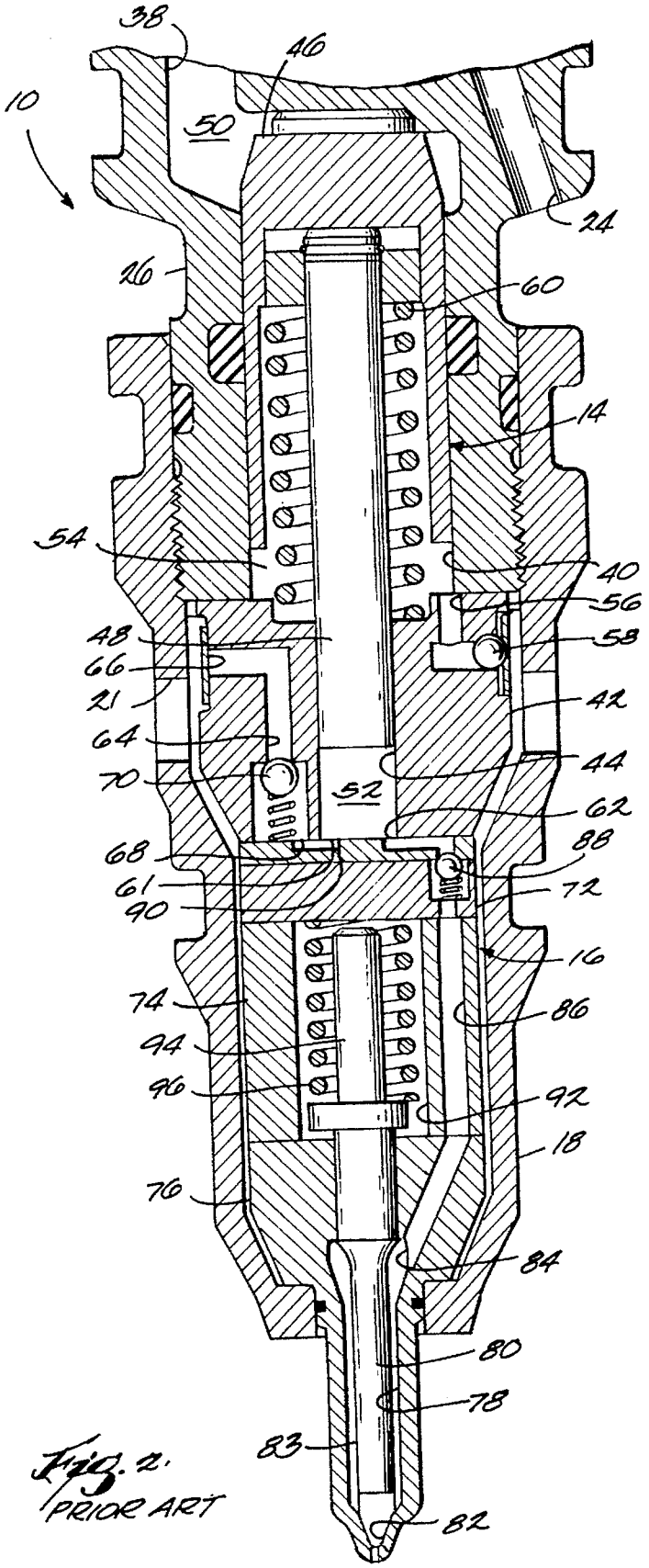
Fig. 2. PRIOR ART
FIG. 2 is a side-sectional-elevation view of the major portion of the non-accumulator-type HEUI assembly of FIG. 1, appropriately labelled "PRIOR ART"

Referring now to FIGS. 1 and 2, a non-accumulator-type HEUI assembly 10 is illustrated which is of the type manufactured by Caterpillar, Inc. of Peoria, Ill. and disclosed, e.g., in U.S. Pat. No. 5,197,867 to Glassey and U.S. Pat. No. 5,287,838 to Wells. Assembly 10 includes from upper to lower end a control. valve assembly 12, an intensifier assembly 14, and an injection nozzle assembly 16 all held together by a nut 18. Assembly 10 is connected to a fuel supply rail 20 via a first inlet port 21 formed in nut 18 and is connected to a control rail 22 via a second inlet port 24 formed in a body 26 of the control valve assembly 12. The illustrated control rail 22 is a lube oil supply rail, but could in practice be the fuel supply rail with minor modifications to the assembly 10.

The control valve assembly 12 is designed to selectively pressurize and depressurize a low pressure chamber of the intensifier assembly 14 for reasons detailed below. Assembly 12 includes the body 26 in which is disposed a two-position three-way poppet valve 28 actuated by a solenoid coil 30 (FIG. 1). Valve body 26 has the inlet port 24 formed therein, an outlet port 32 connected to a vent conduit 34 (FIG. 1), and a control chamber 36 which is always connected to the low pressure chamber 50 of the intensifier assembly 14 via a passage 38 and which, depending upon the position of the valve 28, is selectively connected to the control rail 22 or to vent conduit 34. The lower end of the valve body 26 threadedly receives the upper end of nut 18 and has a central axial bore 40 in which is disposed the upper end of the intensifier assembly 14.

The intensifier assembly 14 comprises a body 42 having a central axial bore 44 formed therein which is aligned with the bore 40 in the valve body 26 and in which is disposed a low-pressure piston 46 and high-pressure plunger 48. Piston 46 and plunger 48 separate the low pressure chamber 50 from a high pressure chamber 52 and define an intermediate chamber 54 which is connected to the fuel supply rail 20 via a passage 56 and a check valve 58 to permit venting of any fluid which leaks into the chamber 54. The piston 46 is biased upwardly by a return spring 60. The high pressure chamber 52 has an inlet 61 and an outlet 62 which is connected to the nozzle needle assembly 16 as will be detailed below. A fuel supply passage 64 is formed in the intensifier body 42 and has an inlet 66 communicating with the first inlet port 21 and an outlet 68 communicating with the high pressure chamber 52 as detailed below. A non-return valve 70 is disposed in the passage 64 and permits fuel to flow freely from the fuel supply rail 20 to the high pressure chamber 52 but prevents return flow therethrough.

The nozzle assembly 16 includes from upper to lower end a spacer or stop member 72, a sleeve 74, and a needle check tip 76 all disposed in axial alignment with one another. A central axial bore 78 is formed in the check tip 76, terminates in a nozzle cavity 82 at its lower end, and is enlarged at an intermediate portion to form a kidney cavity 84. A nozzle needle 80 is disposed in the bore 78 and is stepped so as to be sealed against a guide formed by the upper end portion of the bore 78 but so as to permit unrestricted two-way fluid communications between the kidney cavity 84 and the nozzle cavity 82 through an annulus 83. A fuel discharge passage 86 extends through the spacer 72, sleeve 74, and needle check tip 76 and terminates in the kidney cavity 84, thus fluidically connecting the high pressure chamber 52 to the nozzle cavity 82 via the kidney cavity 84 and annulus 83. A non-return valve 88 is located in the discharge passage 86 and prevents return flow from the nozzle cavity 82 to the high pressure chamber 52 for reasons derailed below. This valve may comprise a ball-type valve as illustrated, a flat-disk-type valve, or any other known non-return valve.

The spacer or stop member 72 has a lower face which acts as a stop for the needle 80 and has an upper arcuate cavity 90 which connects the outlet 68 of the fuel supply passage 64 to the inlet 61 of the high pressure chamber 52.

The sleeve 74 defines a spring chamber 92 which receives a needle plunger 94 of the needle 80 as well as a needle return spring 96. The spring chamber 92 is sealed from the fuel discharge passage 86 but has an outlet in sleeve 74 that connected to the fuel supply passage 64 upstream of the check valve 70 via a passage 98 (not shown in FIG. 2) to permit any pressurized fuel that may leak into the chamber 92 during injection to vent back to the fuel supply rail 20, thereby avoiding overpressurization of chamber 92.

In operation, the tip of needle 80 is normally biased into engagement with its seat by the needle return spring 96, thus preventing injection. Injection is initiated by energizing the solenoid coil 30 to switch the control valve 28 from the position illustrated in FIG. 1 to a position in which the low pressure chamber 50 of the intensifier assembly 14 is connected to the control rail 22. Pressurized fluid flows into the low pressure chamber 50 and drives the piston 46 and plunger 48 downwardly to intensify the pressure in the high pressure chamber 52 by a multiple equal to the ratio of the areas of the piston 46 to the plunger 48, typically about 7:1. Pressure increases correspondingly in the fuel discharge passage 86, kidney cavity 84, annulus 83, and nozzle cavity 82. Injection commences when the lifting forces imposed on the needle 80 by fluid pressure in the nozzle cavity 82 overcome the return forces imposed by the spring 96, and continues through the downward stroke of the intensifier plunger 48. Blowback of gases from the combustion cylinder, which may occur if gas pressures in the combustion chamber are higher than fuel pressure in the nozzle cavity 82 during injection, is said to be prevented by the check valve 88. To terminate injection, solenoid coil 30 is de-energized to reverse the motion of plunger 48, thus depressurizing the high pressure chamber 52, passage 86, and nozzle cavity 82. The needle 80 closes to terminate injection when the lifting forces imposed by the falling fluid pressure in the nozzle cavity 82 are overcome by the forces of the return spring 96. Further upward movement of plunger 48 draws fluid into the high pressure chamber 52 from the fuel supply passage 64 and the check valve 70, thus preparing the assembly 10 for the next injection event.

3. Conversion of Non-Accumulator-Type HEUI Assembly to Accumulator-Type HEUI Assembly Referring now to FIGS. 3 and 4, a non-accumulator-type HEUI assembly 10 can, depending upon the construction of the basic assembly, be converted to an accumulator-type HEUI assembly 100 simply by subjecting a nozzle needle 180 to forces from fluid pressure in the intensifier high pressure chamber 52, thus causing the needle 180 to remain seated upon intensification of fluid pressure in the high pressure chamber 52 and permitting fuel injection to commence only upon subsequent pressure decay in the high pressure chamber 52. This modification can be implemented most easily by adding a sealed needle plunger 194 in two-way fluid communication with the high pressure chamber 52. This addition, and other modifications which, depending upon the construction of the stock injector assemblies, may be required, will now be discussed with reference to a retrofit operation, it being understood that the conversion could also take place during initial assembly using primarily stock injector assembly components but not requiring prior disassembly and replacement of parts.

The sealed plunger 194 could be formed either as a separate element or as part of a replacement needle 180 as illustrated. The needle 180 is otherwise identical to the needle 80 and can be used with the check tip 76. A replacement spacer is provided to receive the plunger 194 and, in the illustrated embodiment, is made from upper and lower sections 172A and 172B to facilitate production. The upper section 172A has an upper arcuate cavity 190 which is identical to the cavity 90 in the stock spacer 72. A central axial bore 200 is formed through the lower section 172B and slidably and sealingly receives the upper end of the plunger 194 so as to define a control cavity 202 between the upper surface of the plunger 194 and the lower surface of the upper spacer section 172A. Control cavity 202 is sealed from the spring chamber 192 but is in free fluid communication with high pressure chamber 52 via a central axial passage 204 formed through the upper spacer section 172A. A side passage portion 186A is formed through the spacer sections 172A and 172B and in use forms part of the fuel discharge passage 186. A check valve 188 is located in the passage portion 186A and may be identical in construction to the stock check valve 88 and, indeed, may be the same valve if the spacer 172 is modified to include the bore 200 and passage 204 rather than being replaced by a separate spacer 172A, 172B.

It is conceivable that the fluid discharge passage 186, kidney cavity 84, and nozzle cavity 82 will provide sufficient volume downstream of the check valve 188 to act as an accumulator, particularly if the passage 186 is enlarged in the conversion process. Additional accumulator volume may, however, be required to trap sufficient fuel downstream of the check valve 188 for higher quantity injection. To this end, the injector assembly is further modified to add the volume of the spring chamber 192 to the accumulator volume by placing it in free fluid communication with the fluid discharge passage 186 while isolating it from direct communication with the fuel supply rail 20. This modification may comprise plugging the outlet port of the existing sleeve 74 and providing a passage through the sleeve 74 connecting the spring chamber to the discharge passage 186, or may comprise replacing the sleeve 74 with a sleeve 174 which lacks the fuel outlet port but which has a radial passage 206 connecting the fuel discharge passage 186 to the spring chamber 192 downstream from check valve 188.

The accumulator-type HEUI assembly 100 is otherwise identical to the non-accumulator-type HEUI assembly 10 of FIGS. 1 and 2 and employs stock components denoted by the same reference numerals used in FIGS. 1 and 2.

In operation, fuel flows into the high pressure chamber 52 of the pressure intensifier assembly 14 upon upward movement of the plunger 48 as described above in connection with FIGS. 1 and 2. The injector assembly 100 is charged or readied for injection by energizing solenoid coil 30 to switch the control valve 28 from the illustrated position in which the intensifier low pressure chamber 50 is connected to the vent conduit 34 to a position in which it is connected to the control rail 22. Pressurized fluid flows into the low pressure chamber 50 and drives the piston 46 and plunger 48 downwardly, thus intensifying fuel pressure in the high pressure chamber 52 as discussed above. Most of the thus-intensified fuel flows through the check valve 188 and into the accumulator volume, but some flows into the control cavity 202 through passage 204. The pressurized fuel in control cavity 202 opposes lifting forces imposed on the needle 180 by the pressurized fuel in the accumulator volume and thus prevents injection.

Figure 3:
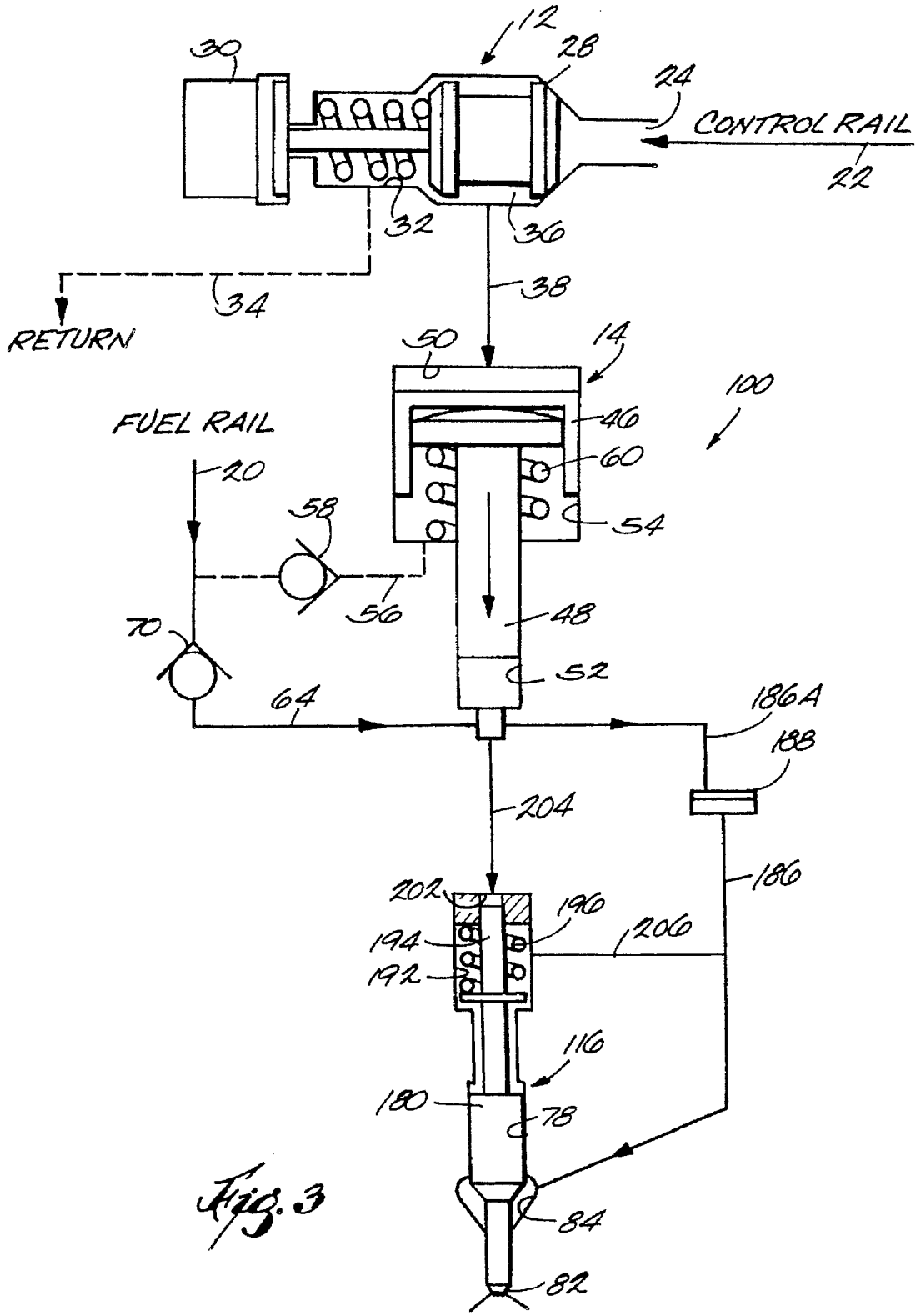
FIG. 3 schematically represents an accumulator-type HEUI assembly producible through conversion of the non-accumulator-type HEUI assembly design of FIGS. 1 and 2.
Figure 4:
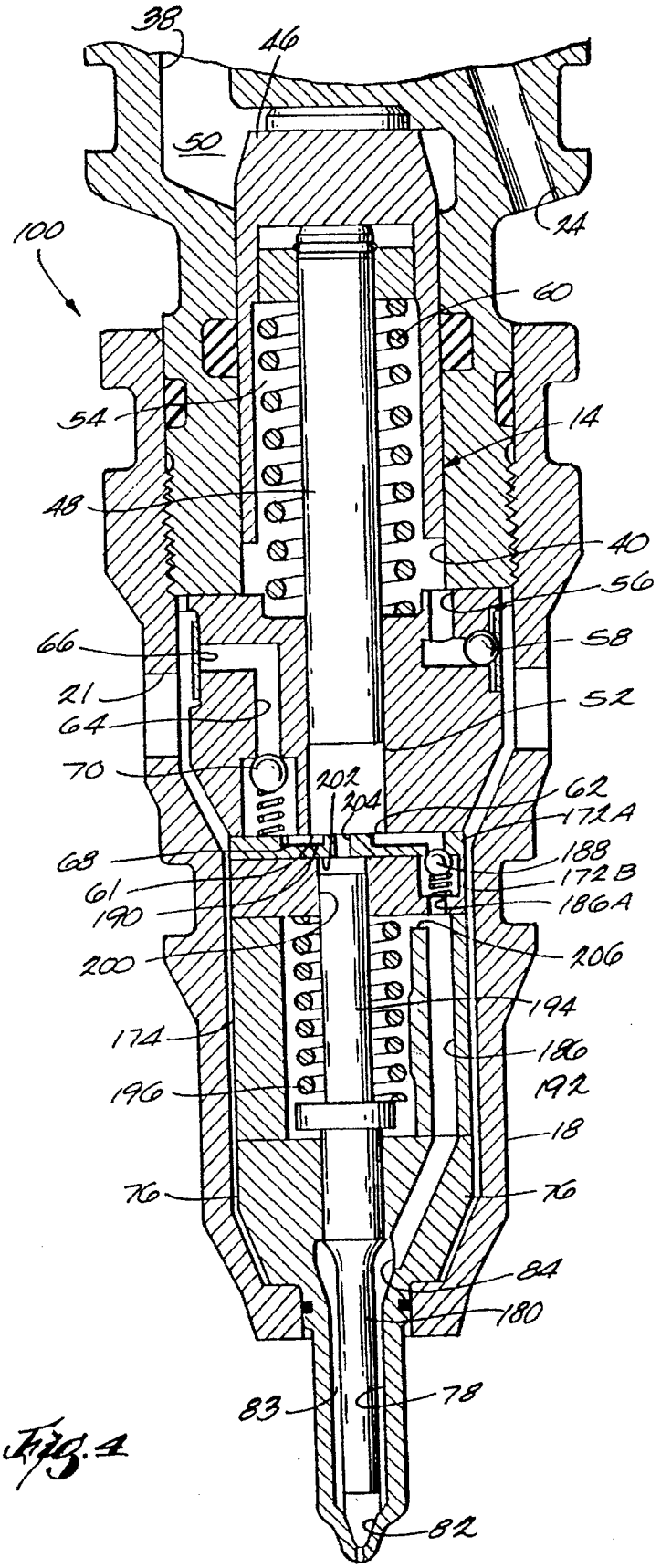
FIG. 4 is a side-sectional-elevation view of the major portion of the accumulator-type HEUI assembly of FIG. 3.

Injection is initiated by deenergizing solenoid coil 30 to return the control valve 28 to the position illustrated in FIG. 3, thereby venting the intensifier low pressure chamber 50 and permitting the piston 46 and plunger 48 to move upwardly and to depressurize the high pressure chamber 52. Fluid pressure also decays in the control cavity 202 at this time, but pressure decay in the accumulator volume is prevented by the check valve 188. Injection commences when the return forces imposed by the needle return spring 196 and the decaying fluid pressure in the control cavity 202 are overcome by the lifting forces imposed by accumulator pressure in the nozzle cavity 82, and continues until fluid pressure in the nozzle cavity 82 falls beneath the level at which the lifting forces imposed thereby are overcome by the return forces imposed by the needle return spring 196 and by the reduced fluid pressure in the control cavity 202. Further upward movement of plunger 48 draws fuel into the high pressure chamber 52 from the fuel supply passage 64 and the check valve 70, thus readying the assembly 100 for the next charging event.

It can thus be seen that the converted injector assembly 100 functions in all respects as an accumulator-type HEUI assembly. An engine can thus be retrofitted with an accumulator-type injection system without replacing the existing injectors, thus rendering such retrofitting cost effective in many applications in which it heretofore would not have been. If for any reason the available space afforded by the existing injector is not sufficient to act as an accumulator under all engine operating conditions, to result in the same delivery, additional components such as sleeve 174 would have to be lengthened to provide sufficient accumulator volume.

In addition, manufacturers of HEUI assemblies will be more apt to convert at least a portion of their production operations to accumulator-type fuel HEUI assembly manufacture because only relatively minor retooling and assembly changes would be required. The invention also promotes standardization and renders low-volume production more cost effective.

It should be noted that many modifications could be made to the invention as disclosed and described without departing from the spirit thereof. While some such changes were described below, the scope of other possible changes will become apparent from the appended claims.

We claim:

1. A method of converting an intensified non-accumulator-type hydraulic electronic unit fuel injector assembly to an intensified accumulator-type hydraulic electronic unit fuel injector assembly, said method including:

(A) providing an intensified non-accumulator-type hydraulic electronic unit fuel injector assembly including (1) an intensifier having a relatively large diameter piston surface and a relatively small diameter plunger surface, a low pressure chamber being formed fluidically above said piston surface and being selectively connectable to a source of pressurized fluid and to vent, and a high pressure chamber being formed fluidically beneath said plunger surface and being connectable to a pressurized fuel source, (2) a central axial bore which includes a lower nozzle cavity and in which is disposed a nozzle needle, and (3) a fuel discharge passage supplying pressurized fuel to said nozzle cavity from said high pressure chamber which lifts said needle to permit injection whenever fluid pressure in said nozzle cavity exceeds a designated level;

(B) forming a control cavity above an upper surface of said needle which is in two-way fluid communication with said high pressure chamber and which permits fluid pressure forces in said control cavity to be transmitted to said needle; and (C) placing a non-return element in said fuel discharge passage which permits substantially unrestricted fluid flow towards said nozzle cavity from said high pressure chamber but which at least substantially prevents return fluid flow therethrough, wherein following said steps (B) and (C), said fuel injector assembly is operable such that said needle remains seated upon downward movement of said plunger surface and consequent intensification of fluid pressure in said high pressure chamber, and wherein said needle lifts to permit fuel injection to commence only upon subsequent pressure decay in said high pressure chamber upon upward movement of said plunger surface.

2. A method as defined in claim 1, wherein said providing step comprises completing assembly of said intensified non-accumulator-type hydraulic electronic unit fuel injector assembly prior to said steps (B) and (C), and wherein said step of placing said non-return element in said fuel discharge passage occurs during said providing step.

3. A method as defined in claim 1, wherein said providing step further comprises providing a spring chamber in which is disposed a needle return spring and which is isolated from direct fluid communication with said fuel discharge passage, and further comprising the step of placing said spring chamber in direct fluid communication with said fuel discharge passage at a location fluidically downstream of said non-return element.

4. A method as defined in claim 3, wherein said providing step comprises providing a sleeve which surrounds said spring chamber and said step of placing said spring chamber in direct fluid communication with said fuel discharge passage comprises one of (1) drilling a passage through said sleeve which connects said fuel discharge passage to said spring chamber and (2) replacing said sleeve with a sleeve having a passage formed therethrough which connects said fuel discharge passage to said spring chamber.

5. A method as defined in claim 3, wherein said step of providing said sleeve comprises providing a sleeve having a bore formed therein for the passage of fluid from said spring chamber to said fuel source, and further comprising one of (1) plugging said bore in said sleeve and (2) replacing said sleeve with a sleeve which lacks said bore.

6. A method as defined in claim 1, wherein said providing step further comprises providing a needle plunger above said needle and providing a spacer at least a portion of which extends above said needle plunger and which lacks a bore permitting two-way fluid flow between said high pressure chamber and said control cavity, and further comprising replacing said needle plunger with another, longer needle plunger and replacing said spacer with another spacer which (1) has a central axial bore formed therein which sealingly surrounds an upper end of said another needle plunger to define said control cavity and to fluidically isolate said control cavity from said spring chamber and which (2) has a passage formed therethrough permitting two-way fluid flow between said high pressure chamber and said control cavity.

7. A method as defined in claim 6, further comprising replacing said needle with a needle having said another needle plunger formed integrally therewith.

8. A method of converting an intensified non-accumulator-type hydraulic electronic unit fuel injector assembly to an intensified accumulator-type hydraulic electronic unit fuel injector assembly, said method including:

(A) providing an intensified non-accumulator-type hydraulic electronic unit fuel injector assembly including (1) an intensifier having a relatively large diameter piston surface and a relatively small diameter plunger surface, a low pressure chamber being formed fluidically above said piston surface and being selectively connectable to a source of pressurized fluid and to vent, and a high pressure chamber being formed fluidically beneath said plunger surface and being connectable to a pressurized fuel source, (2) a central axial bore, said bore including (a) an upper needle guide which slidably and sealingly receives a nozzle needle, and (b) a lower nozzle cavity, (3) a spring chamber (a) located above said bore, (b) receiving a needle return spring, and (c) having an outlet port formed therein which is connected to said fuel source, and (4) a fuel discharge passage which (1) fluidically connects said high pressure chamber to said nozzle cavity and which (2) has a non-return element disposed therein which permits substantially unrestricted fluid flow towards said nozzle cavity from said high pressure chamber but which at least substantially prevents return fluid flow therethrough, said fuel discharge passage supplying pressurized fuel to said nozzle cavity from said high pressure chamber which lifts said needle to permit injection whenever fluid pressure in said nozzle cavity exceeds a designated level;

(B) exposing the upper surface of said needle to forces arising from fluid pressure in said high pressure chamber;

(C) isolating said spring chamber from direct fluid communication with said fuel source; and (D) placing said spring chamber in direct two-way fluid communication with said fuel discharge passage at a location downstream of said non-return element, wherein following said steps (B), (C), and (D) said fuel injector assembly is operable such that said needle remains seated upon downward movement of said plunger surface and consequent intensification of fluid pressure in said high pressure chamber and, and wherein said needle lifts to permit fuel injection to commence only upon subsequent pressure decay in said high pressure chamber upon upward movement of said plunger surface.

9. An intensified accumulator-type hydraulic electronic unit fuel injector assembly comprising:

(A) a body having formed therein (1) a fuel supply passage for the supply of a pressurized fluid from a fuel source, (2) a fuel discharge passage having a non-return element located therein, and (3) a central axial bore including a lower nozzle cavity, said lower nozzle cavity having an inlet connected to an outlet of said fuel discharge passage;

(B) a nozzle needle disposed in said axial bore and including a lower needle tip around which is disposed said nozzle cavity;

(C) a needle plunger having a lower end which engages an upper end of said needle and having and upper end around which is disposed an upper control cavity, an intermediate portion of said needle plunger being surrounded by a spring chamber in which is disposed a needle return spring, said spring chamber being sealed at a lower portion thereof and having an upper portion opening into said fuel discharge passage at a location beneath said non-return element;

(D) an intensifier disposed in said body and having a relatively large diameter piston surface and a relatively small diameter plunger surface, a low pressure chamber being formed fluidically above said piston surface and being selectively connectable to a source of pressurized fluid and to vent, and a high pressure chamber being formed fluidically beneath said plunger surface and being connectable to said fuel supply passage; and (E) a spacer which is disposed in said body beneath said intensifier, said spacer having (1) an axial bore formed therein which sealingly and slidably receives said upper end of said needle plunger, said upper control cavity being formed by a portion of said spacer bore above said needle plunger, and (2) a passage formed therethrough connecting said upper control cavity to said high pressure chamber and permitting two-way fluid flow therethrough.

10. An assembly as defined in claim 9, wherein said non-return element is provided in said spacer.

11. An injector as defined in claim 10, wherein said non-return element comprises one of a ball-type check valve and a flat-disc-type check valve.

* * * * *